United States Patent [19]

Furia

[11] 3,975,924

[45] Aug. 24, 1976

[54] PROCESS FOR THE FORMING OF A COLLANT ARTICLE OR THE LIKE WITH A TWO OPPOSITE CYLINDERS CIRCULAR HOSIERY MACHINE

[75] Inventor: Edoardo Furia, Florence, Italy

[73] Assignee: Solis S.r.l., Italy

[22] Filed: Aug. 6, 1974

[21] Appl. No.: 495,203

[30] Foreign Application Priority Data

Aug. 10, 1973 Italy ..... 9589/73

[52] U.S. Cl. ..... 66/14; 66/177

[51] Int. Cl.[2] ..... A41B 9/02; A41B 9/04; A41B 9/10

[58] Field of Search ..... 66/14, 22, 175, 176, 66/177

[56] References Cited

UNITED STATES PATENTS

| | | | |
|---|---|---|---|
| 3,595,034 | 7/1971 | Safrit | 66/177 |
| 3,815,385 | 6/1974 | Gariboldi | 66/177 X |

FOREIGN PATENTS OR APPLICATIONS

| | | | |
|---|---|---|---|
| 1,809,378 | 6/1970 | Germany | 66/177 |

OTHER PUBLICATIONS

*The Hosiery Trade Journal*, June 1973, vol. 80, No. 954, pp. 99 & 100.

Knitting Times, Apr. 29, 1974, vol. 43, No. 18, pp. 28–33.

*Primary Examiner*—Ronald Feldbaum

*Attorney, Agent, or Firm*—McGlew and Tuttle

[57] ABSTRACT

The process is designed for the forming of a collant, i.e. pantyhose article or the like, with a double cylinder circular hosiery machine. The two legs or the like are knit on two cylinders in a simultaneous manner, with a continuous rotational motion, and the pant portion is formed with a fabric knit alternately on the two cylinders, to which the yarn is alternately fed. During the forming of the pant portion one proceeds with a continuous rotational motion of the two cylinders, passing the yarn from the needles of the first cylinder to the needles of the second cylinder at a position angularly spaced from the one wherein the yarn has passed from the needles of the second cylinder to those of the first cylinder. In this manner the tubular fabrics formed by the two cylinders are bound with one another at least at these two positions. In correspondence with the intermediate fabric portion between the two positions, a longitudinal separation cutting is effected.

10 Claims, 13 Drawing Figures

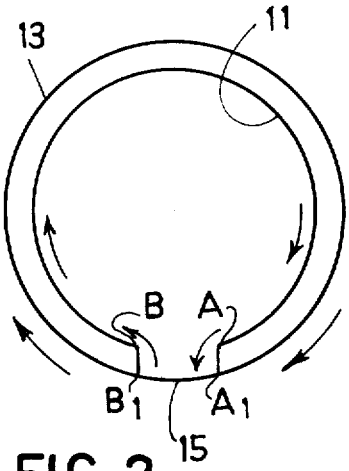
FIG. 1
FIG. 2
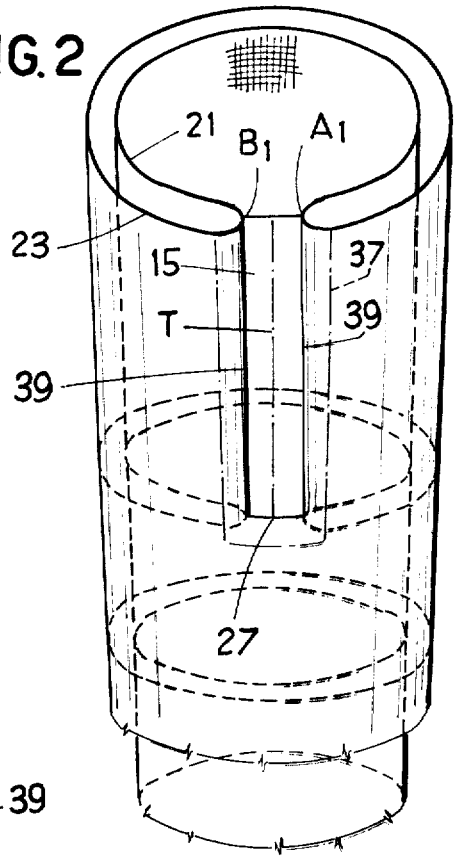
FIG. 3
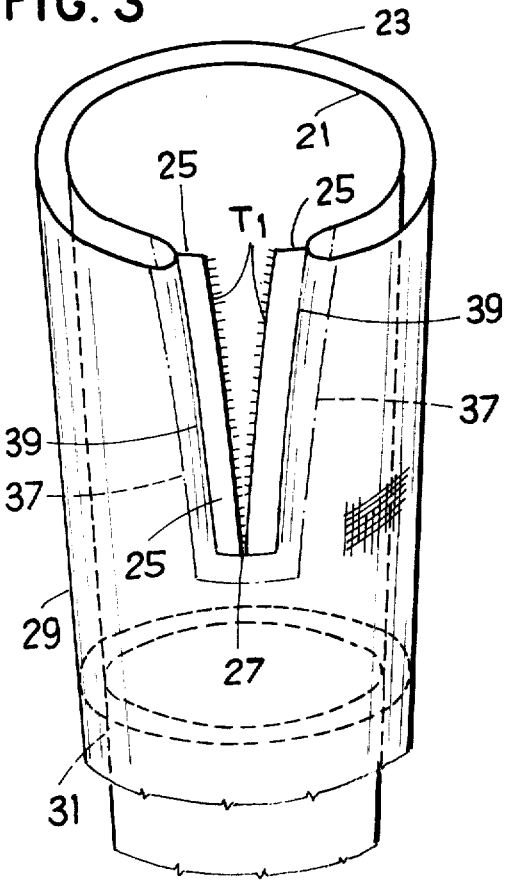
FIG. 4
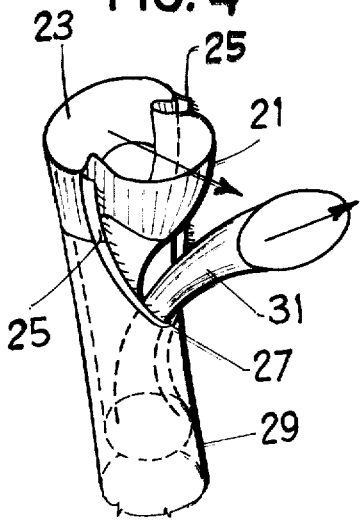

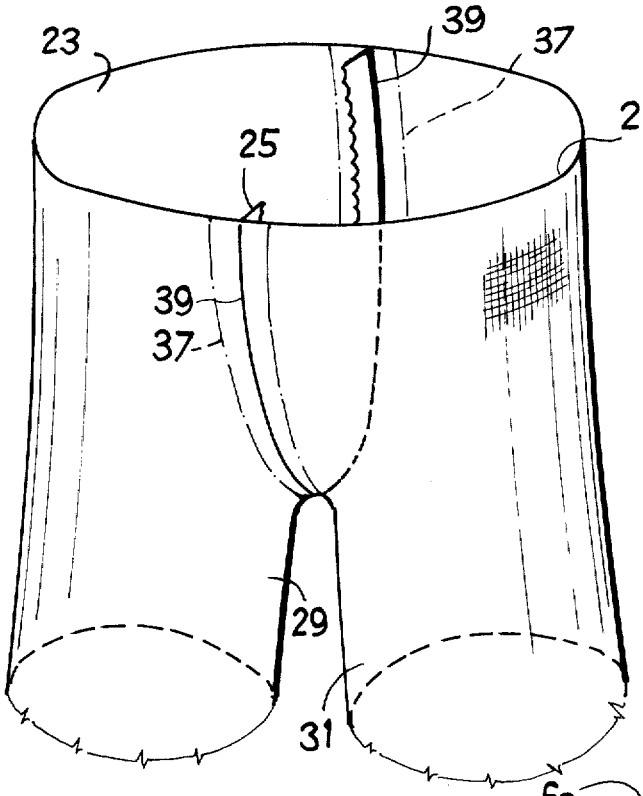
FIG.5
FIG.6
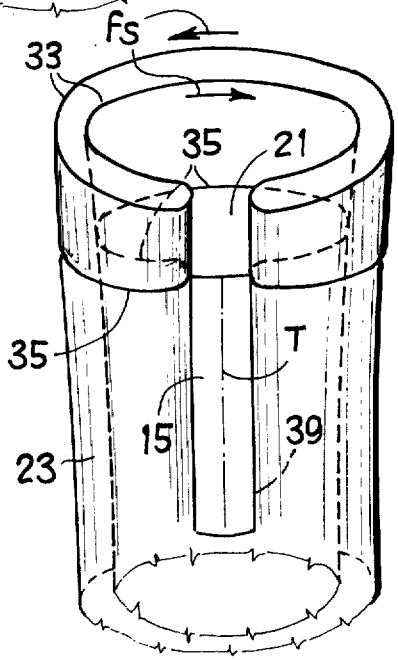
FIG.7
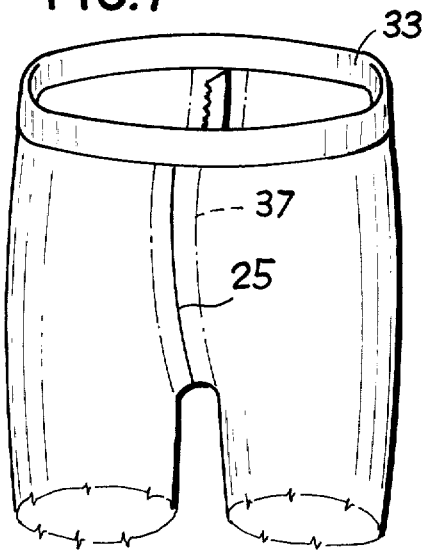

FIG. 8
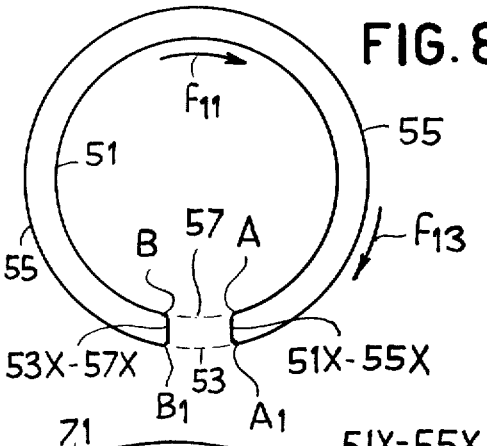
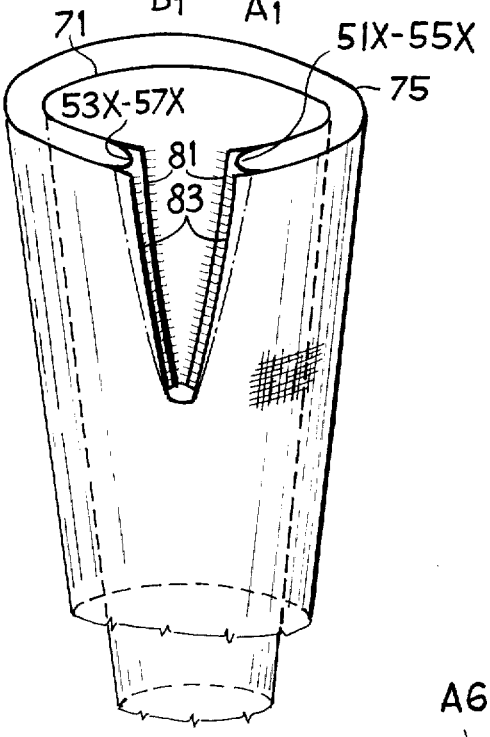
FIG. 9
FIG. 10
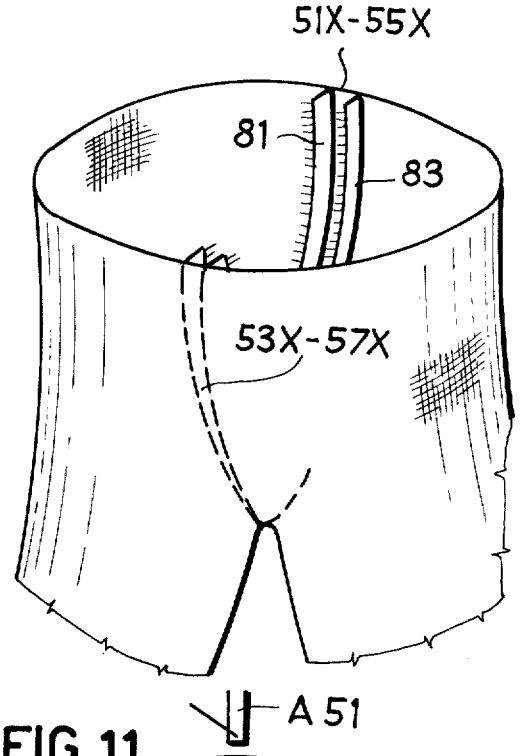
FIG. 11
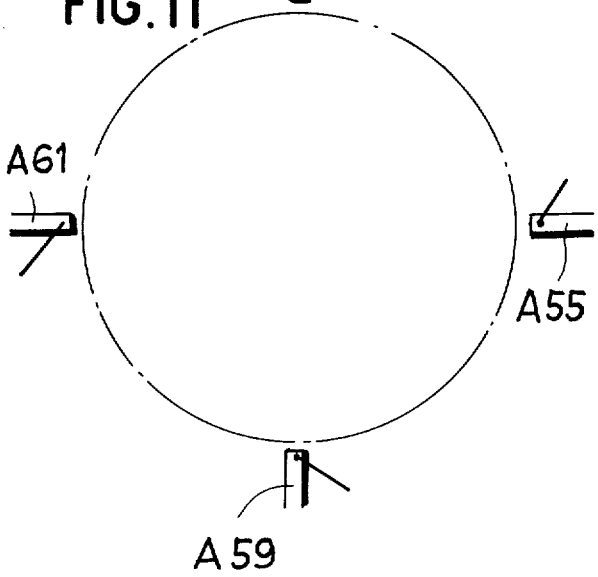

PROCESS FOR THE FORMING OF A COLLANT ARTICLE OR THE LIKE WITH A TWO OPPOSITE CYLINDERS CIRCULAR HOSIERY MACHINE

FIELD AND BACKGROUND OF THE INVENTION

The object of the invention is a process for the forming of a collant, i.e. pantyhose article or the like, with a double cylinder circular hosiery machine, forming the two legs or the like on two cylinders in a simultaneous manner, with a continuous rotational motion, and forming the pant portion with a fabric knit alternately on the two cylinders, to which the yarn is alternately fed.

In the Italian Patent No. 916,700 filed on Aug. 25, 1970, in the U.S. patent application Ser. No. 171,169 of Aug. 12, 1971, now re-filed as Continuation-In-Part application Ser. No. 455,387 on Mar. 27, 1974, and in French Patent No. 7,130,798 filed on Aug. 25, 1971, there is provided a process of this kind, wherein the pant portion is formed with a reciprocating or oscillating motion of the needle cylinder in phase with the passage of the yarn feed from the one to the other cylinder.

SUMMARY OF THE INVENTION

According to the present invention, in order to increase the output speed of the pant portion (which in the previous system was restricted by the continuous reversals of the motion and by the requirement of limiting the yarn feeds), and to obtain particular knitting effects (as the so-called tuck stitch) in an easy manner, during the forming of the pant portion one proceeds with a continuous rotational motion of the two cylinders, passing the yarn from the needles of the first cylinder to the needles of the second cylinder at a position angularly spaced from the one wherein the yarn has passed from the needles of the second cylinder to those of the first cylinder in such a manner that the tubular fabrics formed by the two cylinders are bound with one another at least in the two positions. In correspondence with the intermediate fabric portion these two positions, a longitudinal separation cutting is effected. For the passage of the yarn from the needles of one cylinder to those of the other one, the process is known, for example by means of the needle selective control as in the conventional double cylinder machines.

In the intermediate fabric portion between the two passage positions of the yarn from the needles of one cylinder to those of the other cylinder, at least adjacent these two positions, the needles which are active in the intermediate fabric portion are advantageously selected to form a ladderproof fabric. Bands of ladderproof fabric may be formed also adjacent these two positions, on the outside of the gap, intermediate fabric portion by the needles of the two cylinders.

In an intermediate zone of the intermediate fabric portion the needles may also be selected in order not to knit, respectively to form an edge, so as to proceed to the shearing in correspondence with the intermediate zone.

According to a possible embodiment, in the intermediate fabric portion between the two passage positions of the yarn from the needles of one of the cylinders to the needles of the other cylinder, only the needles of one of the two cylinders are active. The needles may be operated in such a manner whereby the yarn of a single feed passes from the needles of the first cylinder to the needles of the second cylinder in a first one of the two positions, forms stitches with the needles of the second cylinder for an entire circumference plus the intermediate fabric portion, and then passes again to the needles of the first cylinder in the second position, to form stitches for an entire circumference minus the intermediate fabric portion. The needles may also be operated in such a manner whereby with the yarn of the first yarn of two feeds, circular courses are constantly knitted with all the needles on a first of the two cylinders (for instance the lower one), while the second yarn of a second feed is operated by all the needles of the second cylinder (for instance the upper one) except the needles of the intermediate fabric portion, in correspondence with which the second yarn is seized again by the needles of the gap of the first cylinder.

According to another possible embodiment, operating at least simultaneously with two yarns arranged to form the connection, the needles are operated so that, in front of one feed, the associated yarn is seized by the needles of a first cylinder during the entire circumference except in the gap, and by the needles of the second cylinder in correspondence with the gap In front of the other feed, the associated yarn is seized by the needles of the second cylinder during the entire circumference except in the intermediate fabric portion and by the needles of the first cylinder in correspondence with the said intermediate fabric portion.

In practice provisions are set up to form additionally, by the needles of each cylinder with an additional respective yarn in another feed position, a course of stitches interposed to the courses formed with the connection yarns.

When an elastic band knit along the waist line is provided, it can be knit by reciprocating motion of the needle cylinders, as in the above stated Patents, to form an endless fabric without any yarn shearing. In the other portions of the pant, the proceeding is as above stated.

The invention relates also to an article made by the above process, as well as to the means for making the same especially a machine equipped to produce the article according to the above process.

BRIEF DESCRIPTION OF THE DRAWINGS

The invention will be better understood following the specification and the accompanying drawing, which illustrates an embodiment not restricting the same invention. In the drawing:

FIG. 1 illustrates in a very schematic manner a portion of double concentric fabric for the forming of the pant portion according to the criteria of the invention;

FIGS. 2 and 3 are perspective views respectively illustrating the article as it is coming out of the machine before shearing and as sheared;

FIGS. 4 and 5 respectively illustrate the article in the over-turning and out-flexure stage and the article after being over-turned;

FIGS. 6 and 7 illustrate a variation of the process in perspective views under the conditions wherein the article comes out of the machine and with the extended article, respectively;

FIGS. 8, 9 and 10 illustrate a variation of the process similarly to FIGS. 1, 3 and 5;

FIG. 11 illustrates a scheme of several yarn feeds;

DESCRIPTION OF THE PREFERRED EMBODIMENTS

According to the accompanying drawing, a double tubular article is formed and developed as in the above indicated patents, but also operating in the pant region with a continuous circular motion, and merely passing from one cylinder to the other with the yarn feed or the feed of each weaving yarn. The continuous rotational motion allows an increase of the speed and an increase of the number of yarn feeds with respect to what is possible to obtain by operating with a reciprocating motion of the cylinders,, as takes place in the aforesaid patents.

Referring to FIG. 1, and assuming that the rotation of the two needle cylinders is as indicated by the arrows, a first course of stitches 11 is provided by feeding the yarn to the needles of the upper cylinder, for example, the course of stitches 11 terminating at the point A. At this point, the yarn feed is transferred from the needle of the upper cylinder then at the point A to the corresponding needle of the lower cylinder then at the point A1. Knitting is then effected by the needles of the lower cylinder through the arc between the points A1 and B1 and then further to form a course of stitches 13 with the needles of the lower cylinder. This course is continued past the point A1 through the intermediate fabric portion 15 to the point B1, with the needles of the lower cylinder forming the intermediate fabric portion 15. At the point B1, the yarn feed is transferred from the needle, of the lower cylinder, then at this point to the needle of the upper cylinder then at the point B to form an additional course 11 again terminating at the point A where the yarn from the needle of the upper cylinder then at the point A is passed to the corresponding needle of the lower cylinder then at the point A1. The operations are then repeated. It is to be noted that the needles of one of the cylinders — according to the embodiment those of the upper cylinder — included in the arc A-B never operate in this stage of forming of the pant portion, while, of the corresponding needles of the other cylinder — in the embodiment the lower one — included in the arc A1-B1, all operate or only a portion thereof, and in the latter case only those adjacent the ends A1 and B1 of arc A1-B1. This work proceeds for the longitudinal development which corresponds to the pant portion, that is for development of the so-called crutch.

Figure 13:
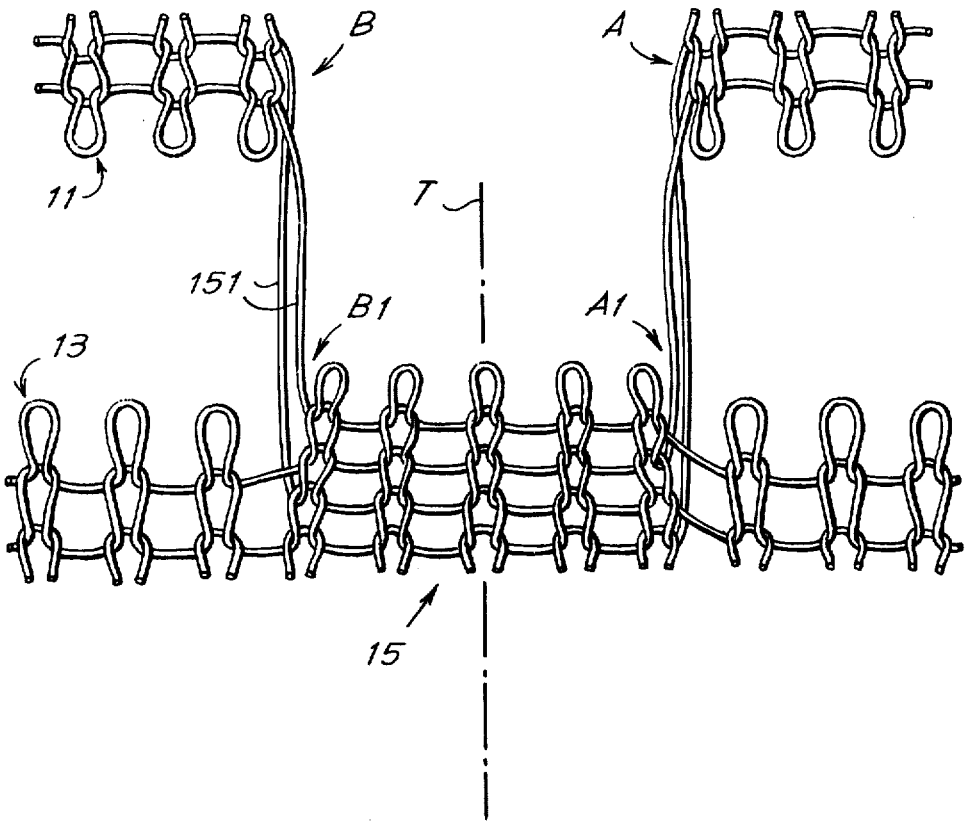
FIG. 13 is a view, similar to FIG. 12, illustrating the structure of the article in the needles exchanging zone in the embodiment of the invention shown in FIGS. 1 through 5.

FIG. 13 illustrates a corresponding conventional representation of the fabric as formed in the embodiment of FIGS. 1 through 5. Referring to FIG. 13, which, as stated, illustrates the structure of the fabric in the case of knitting according to the embodiments of FIGS. 1 through 5, in knitting the intermediate fabric portion 15, the yarns which form the fabric portion including the courses 11 on the needles of the upper cylinder are transferred to the needles of the lower cylinder. Thus, the intermediate fabric portion 15 is knit by the needles of the lower cylinder, rather than those of the upper cylinder, in the arc included between the points A and B, or between the points A1 and B1. Between the points A and B, the needles of the upper cylinder are ineffective, as the yarn has been taken by the needles of the lower cylinder. The intermediate fabric portion 15 is cut along the line T to form the two lips 25 shown in FIG. 3.

At the time when the knitting has progressed to the point 27 of FIG. 3, and has passed this point, the needles in front of the respective feeds are operated so that the needles of the upper cylinder now begin to knit along the arc A–B while the needles of the lower cylinder continue to operate along the arc A1–B1 taking the yarn used to form the fabric constituted by the courses 13. At the same time, the function of the shearing device, which is combined with the machine, in forming the cut T, is terminated. For convenience, in FIG. 13, the intermediate fabric portion or zone 15 and the corresponding zones on either side thereof are represented as plain stitches, but these will, in practice, be formed with an appropriate ladderproof interlacing for a suitable number of courses. The transfer of the yarns between the needles of the two cylinders is indicated at 151 in FIG. 13.

It is also possible to produce the article by initially knitting the leg followed by knitting of the pant portion. In such case, and with continual synchronous rotation of the two needle cylinders, the needles of each cylinder are fed with respective different yarns to form the courses 11 on the upper cylinder and the courses 13 on the lower cylinder, with continuous rotation of the two cylinders in the same direction, thus forming the legs 29 and 31. At or about the point 27, the knitting of the pant portion commences and is continued in the manner described for FIGS. 1 through 5 with severing of the intermediate fabric portion along the line T. That is, a course 11 knit by the needles of the upper cylinder is terminated at the point A, and the yarn is then transferred to the needles of the lower cylinder at the point A1. The intermediate fabric portion 15 and the course 13 are the knit solely by the needles of the lower cylinder, with the course 13 being continued past the point A1 to the point B1. At the point B1, the yarn is transferred from the needles of the lower cylinder back to the needles of the upper cylinder then at the point B, and the procedure is repeated.

Whichever the mode of proceeding for the forming of the article, during and after the forming of the article there then follows the shearing of the same article in the intermediate fabric portion zone 15 included between the points A1 and B1. The shearing may be carried out during the forming of the pant portion of the article with one of the several systems and devices known in the field, for instance according to the Italian Utility Model No. 133,792 filed on December 5, 1968 and granted on June 4, 1969, and in any other known manner.

In view of the longitudinal shearing to be effected in the zone 15 along the line indicated by T, there may be excluded from working of the needles, a small central zone of the length 15 to form a narrow edge or side, in correspondence with which the shearing can be effected without an excessive accuracy. Still, in view of the fact that the longitudinal shearing is to be made and thus an interruption of the continuity of the circumferential courses, there can advantageously be formed — adjacent the shearing zone — a knitting of so-called ladderproof stitches and practically such as to offer a substantial resistance to destruction of the fabric. This knitting may be effected by only the active needles in the arc A1–B1 forming the zone 15, or also by needles contiguous to this arc, and in this case, both by the needles of the lower cylinder and those of the upper cylinder, to obtain, with a ladderproof knitting and stitches of the courses 11 and 13.

The article produced in the aforesaid manner and in which the longitudinal shearing T has been made, appears as shown in FIG. 3, wherein there will be noted an inner fabric 21 formed by the courses 11, an outer fabric 23 formed by the courses 13, and two edge lips 25 formed by the intermediate fabric zone created by the active needles included in the arc A1–B1, these lips being limited by the shearing edges T1 determined by the shearing T. Beyond the final point 27, the longitudinal shearing ends, and thus one has the passage from the alternate feed system between the two cylinders to the independent and constant feed system to each cylinder. There is thus obtained the respective legs 29 and 31, the tubular leg 29 forming the continuation of the fabric 23 and the leg 31 forming the continuation of the fabric 21.

In FIGS. 6 and 7, there is shown a proceeding which provides a partial working with a reciprocating motion by the needle cylinders, when the forming of an elastic band 33 along the waist zone is dealt with. In this case, the pant portion is worked as above described, but preliminarily to the latter (or subsequently to the latter and at the end of the article forming) there is used a reciprocating motion of the cylinders for the forming of the band 33, knitting band 33 without shearing of the elastic yarn and with courses produced according to the opposite arrows $F_s$ shown in FIG. 6. After having formed the band 33 with a reciprocating motion (if this is the first stage of the article forming), starting from the line 35, the needles are operated with a continuous motion to form the fabrics 21 and 23 and the longitudinal shearing T for the separation is carried out.

When the article has been made on the machine, and with the shearing T having been provided, the article in the condition of FIG. 3 or in the condition of FIG. 6 is withdrawn to attain the form shown in FIG. 5 and, respectively, in FIG. 7. FIG. 4 illustrates a condition assumed during this withdrawal stage, that is a out-flexion stage.

In the drawing, and in particular in FIGS. 3, 5 and 7, 37 denotes a marking line between the usual fabric zone and the ladderproof knitted fabric, to assure the stability of the stitches adjacent the shearing zone T and that of the edges T1. The line 37 might also coincide with the line 39 joining the fabrics 21 and 23 with the edge or selvedge lips 25, line 39 coinciding with the rows of stitches formed by the needles in the positions A1 and B1.

According to a variation of this embodiment, with the yarn of a first feed and with the needles of a first cylinder, there are formed circumferentially complete courses 13, and with the yarn of another feed there are formed the courses 11 with the needles of the second or other cylinder and the courses 15 with the needles of the first cylinders.

It is advantageous to form the pant portion with a continuous motion of the needle cylinders. Apart from the simplification of the kinematics, there is the substantial possibility of maintaining a relatively very high rotational speed, and also the possibility of forming the pant portion of the article with a relatively high number of feeds. This is obtained to an even greater extent in the second hereinafter described embodiment.

According to the embodiment of FIGS. 8 to 12, there is provided a working with a continuous motion, wherein there occurs a passage of the yarn from the needles of one cylinder to the needles of the other cylinder in the arc or intermediate fabric portion between the points A, A1 and the points B, B1, this being obtained — as also in the previous case — by means of the needle controls of the two cylinders, while the yarn-guides may be kept in a fixed position at a substantially equal distance from both cylinders. More particularly, the yarn of a first feed is used to form a course of stitches 51, for instance with the needles of the upper cylinder and in the direction of the arrow *f*11 of FIG. 8 to the point A. At the point A there occurs — in front of the feed of the first yarn — a control of the needles such as to exclude the needles of the upper cylinder and cause the needles of the arc A1–B1 of the lower cylinder to act in order to form stitches 53. In correspondence with the point B1 there occurs again a control of the needles such as to exclude the needles of the lower cylinder and begin again, with the needles of the upper cylinder an additional course of stitches 51. The needles of the lower cylinder in front of a second yarn feed form a course of stitches 55 according to the arrow *f*13 to the point A1, where the yarn is seized by the needles of the upper cylinder to form the zone of stitches 57 between the points A and B. Thereafter the forming of another course of stitches 55 is re-assumed.

Figure 12:
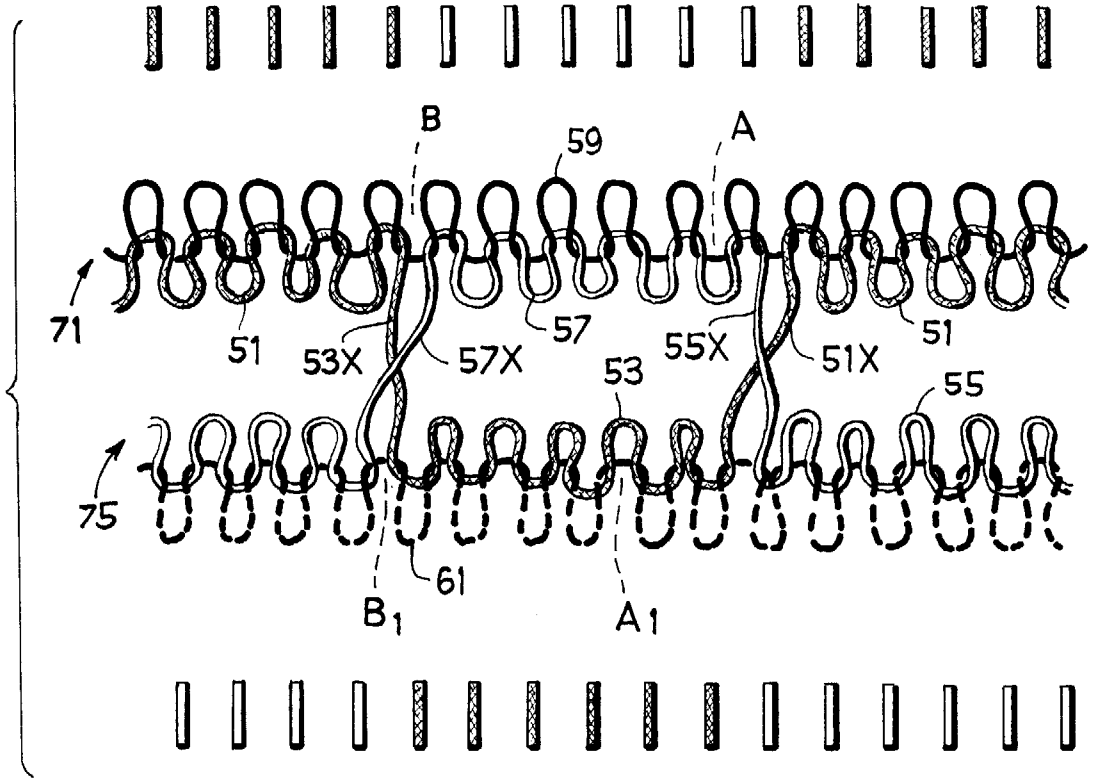
FIG. 12 schematically illustrates the structure of the article in the needles exchanging zone in this variation.

FIG. 12 shows the development of four subsequent courses formed during a revolution of the needle cylinders, in a four-feeds machine in which there are provided (also see FIG. 11) spaced feeds A51, A55 for the yarns which form the courses 51, 53 and 55, 57 and which are binding yarns between the fabrics formed by the two cylinders, the binding taking place in correspondence with jumpers or connections 51X, 53X and 55X, 57X in the passage of the yarn from the needles of one cylinder to those of the other. Besides the two feeds A51, A55 for the mentioned yarns, which are binding yarns, there may be provided additional feeds such as A59 and A61 which supply the upper cylinder and, respectively, the lower cylinder, with yarns for the forming of continuous courses such as those indicated by 59 and 61 in FIG. 12. Therefore, each of the fabrics 71 and 75 formed by the two cylinders with the greater part of the respective needles, is formed with a continuous course and with a course of binding yarn. The fabric 71 formed by the upper cylinder is set up — according to FIG. 12 — by a course 59 obtained with the feed A59 and by a course 51-57 formed, for most of the stitches 51, with the yarn of the feed A51 and, for a short length of stitches 57, with the yarn of the feed A55. The fabric 75 formed by the lower cylinder is set up by a course 61 obtained with the feed A61 and by a course 55–53 formed for the most of the stitches 55, with the yarn of the feed A55 and, for a short length of stitches 53, with the yarn of the feed A51.

In order to obtain the above, the knitting is effected in the following manner in correspondence with the four considered feeds. In front of the feed A51 the needles of the upper cylinder are selected to seize the yarn and form the courses 51, except the group of needles in the gap between A and B. The needles of the lower cylinder are all inactive except the group of the needles in the gap between A1 and B1, which seize the yarn to form the short courses 53. In front of the feed A55, the needles of the upper cylinder are inactive, except the group of the needles in the gap between A and B where they form the short courses of stitches 57. The needles of the lower cylinder are selected to seize the yarn and form the courses 55, except the group of the needles in the gap between A1 and B1, which remain inactive (while the stitches 57 are formed with the upper needles). In front of the feed A59, the needles of the upper cylinder are all controlled to form the courses of stitches 59 (two courses 59 having interposed therebetween a course 51–57). The needles of the lower cylinder are kept inactive. In front of the feed A61, the needles of the lower cylinder are all controlled to form the courses of stitches 61 (a course 55–53 being interposed between two courses 61). The needles of the upper cylinder are kept inactive.

In the scheme of FIG. 11, for practicality the four feeds are arranged at 90° from each other, but obviously the distribution of the feeds along the circumferential periphery of the needles may be modified according to size requirements. Also the distribution of the subsequent feeds may be modified with respect to the indicated one.

In the illustrated scheme, there are provided four feeds, but it is sufficient to provide for a total of feeds which is even, in order to have half of the feeds at least predominantly designed for one of the fabrics and the other half for the other of the fabrics. The feeds also designed for each fabric (and nominally thus to each cylinder) are advantageously in an even number, and thus totally there are, in this case, $4n$ feeds.

The courses of stitches between the points A and B and A1 and B1 include a number of stitches such as to assure the integrity of the lips or flaps obtained with the subsequent shearing. For instance, stitches may be formed with 12 to 20 or more needles.

During the working, in the arc between A and B, (and thus between A1 and B1) and also adjacently but outside each arc, there could be provided a selection of the active needles such as to form a ladderproof fabric or the like susceptible of hindering the destruction of the fabric, when one proceeds to the shearing in an intermediate zone of the arc. The shearing takes place in correspondence with the stitches 57 and 53 and of the corresponding stitches of the interposed courses 59 and 61. In FIGS. 9 and 10, 81 and 83 denote two fabric flaps which face each other with the yarns sheared, which are derived from the shearing of the fabrics formed by the stitches 53 (and corresponding stitches 61) and 57 (and corresponding stitches 59). The two flaps 81 and 83 form substantially edges or selvedges which generally tend to roll up also together with each other, giving a seam similar to that of a sewing along the crutch line. The two flaps 81 and 83 are thus spaced from each other by a very short intermediate fabric portion, which is formed by the jumpers or connections 51X-55X on one side and by the jumpers 53X-57X on the other side. These jumpers or connections have a very short development, and the development relies upon the structural requirements which impose a certain distance between the two opposite cylinders.

While specific embodiments of the invention have been shown and described in detail to illustrate the application of the principles of the invention, it will be understood that the invention may be embodied otherwise without departing from such principles.

What is claimed is:

1. In a process for the production of a collant, pantyhose article, or the like using a circular hosiery machine having concentric first and second cylinders, by forming each leg on a respective one of the two cylinders in a simultaneous manner with a continuous rotational motion and forming the pant portion by forming a fabric alternately on the two cylinders, the steps of:

forming the pant portion with a continuous rotational motion of the two cylinders, during such continuous rotational motion of the two cylinders, in a first step, forming at least one course with the needles of the first cylinder; in a second step, passing the yarn from the needles of the first cylinder to the needles of the second cylinder at a first position; in a third step, forming at least one complete course on the needles of the second cylinder; in a fourth step, passing the yarn from the needles of the second cylinder to those of the first cylinder at a second position spaced angularly from the first position; then repeating said four steps; whereby the respective tubular fabrics formed by the two cylinders are bound to each other at least at said two positions, and a fabric portion extends between said two positions; and effecting a longitudinal cutting of the fabric portion extending between said two positions.

2. Process as in claim 1, wherein the fabric portion between said two passage positions of the yarn from the needles of one cylinder to those of the other cylinder is formed as a ladderproof fabric, at least adjacent said two positions.

3. Process as in claim 2, wherein bands of ladderproof fabric are formed adjacent said two positions, on the outside of said fabric portion.

4. Process as in claim 1, wherein in an intermediate zone of said fabric portion, where the longitudinal cutting is effected, a non-knitted zone, respectively a selvedge is formed.

5. Process as in claim 1, wherein, in the intermediate fabric portion between said two passage positions of the yarn from the needles of one cylinder to the needles of the other cylinder, the needles of only one of the two cylinders are active.

6. Process as in claim 5, wherein a yarn of the same feed passes from the needles of the first cylinder to the needles of the second cylinder in a first of said positions, forms stitches with the needles of said second cylinder, for an entire circumference plus said fabric portion, then passes again to the needles of said first cylinder in said second position, to form stitches for an entire circumference minus said fabric portion.

7. Process as in claim 1, wherein with the yarn of a first feed, circular continuous courses are knit constantly, with all the needles of a first cylinder, while the yarn of a second feed is knit by all the needles of the second cylinder except those needles of said intermediate, in correspondence with which said lastmentioned yarn is seized again by the needles of the first cylinder.

8. Process as in claim 1, wherein, in front of a feed, a connection yarn is seized by the needles of a first cylinder around the entire circumference except in said fabric portion, and by the needles of the second cylinder in correspondence with said fabric portion, and in front of another feed, a respective connection yarn is seized by the needles of the second cylinder around the entire circumference except in said fabric portion, and by the needles of the first cylinder in correspondence of said fabric portion.

9. Process as in claim 8, wherein by means of an additional yarn, a course of stitches interposed with respect to courses formed with said connection yarns, is formed.

10. Process as in claim 8, wherein an elastic band along the waist line is knit with a reciprocating motion of the needle cylinders, to form a continuous fabric without any yarn shearing.

* * * * *